US006240558B1

(12) United States Patent
Makris et al.

(10) Patent No.: US 6,240,558 B1
(45) Date of Patent: Jun. 5, 2001

(54) HAND PROTECTION SYSTEM

(75) Inventors: Aristidis Makris, Nepean; Bradley C. Lavallee, Gloucester; David P. Rozon, Russell; Jeff G. Nerenberg, Ottawa; Justin E. Myles, Carlsbad Springs; Mark Smith, Nepean; Pierre Voisine, Limoges; Raymond C. James, Ottawa; Shaik M. Kalaam, Nepean, all of (CA)

(73) Assignee: Med-Eng Systems Inc., Ontario (CA)

( * ) Notice: Subject to any disclaimer, the term of this patent is extended or adjusted under 35 U.S.C. 154(b) by 0 days.

(21) Appl. No.: 09/518,306

(22) Filed: Mar. 3, 2000

(51) Int. Cl.[7] ..... A41D 13/08; F41H 5/02
(52) U.S. Cl. ..... 2/16; 2/2.5; 89/36.02
(58) Field of Search ..... 2/455, 2.5, 16, 2/17, 161.1, 22, 910, 158–159; 89/36.01, 36.02; 428/105, 113, 408, 412, 902, 911

(56) References Cited

U.S. PATENT DOCUMENTS

| | | | | |
|---|---|---|---|---|
| 2,497,749 | * | 2/1950 | Wagner | 2/16 |
| 3,746,356 | * | 7/1973 | Shipstad | 2/18 |
| 3,874,686 | * | 4/1975 | Shipstad et al. | 2/18 |
| 3,945,045 | * | 3/1976 | Rhee | 2/16 |
| 4,302,851 | * | 12/1981 | Adair | 2/158 |
| 4,309,487 | * | 1/1982 | Holmes | 428/516 |
| 4,361,912 | * | 12/1982 | Arthur | 2/18 |
| 5,326,606 | * | 7/1994 | Labock | 428/49 |
| 5,635,288 | * | 6/1997 | Park | 428/105 |
| 5,740,551 | * | 4/1998 | Walker | 2/16 |
| 6,021,523 | * | 2/2000 | Vero | 2/159 |
| 6,119,575 | * | 9/2000 | Dragione et al. | 89/36.05 |

* cited by examiner

*Primary Examiner*—John J. Calvert
*Assistant Examiner*—Tejash Patel
(74) *Attorney, Agent, or Firm*—Rockey, Milnamow & Katz, Ltd.

(57) ABSTRACT

A hand protection system for use by individuals involved in de-mining operations to locate and identify buried anti-personnel mines is designed to provide a degree of protection to the hands of the operative while still enabling the hands to perform necessary operations such as manipulating a probe rod, clearing soil by use of the fingers, etc. In one form the hand protector is a trough-shaped shield which tapers to a rounded forward end and is adapted to fit over the back of the hand of the user, the shield being open on its underside so that the user's fingers can be manipulated. In another form the hand protecting shield is of conical shape having a hole through its narrow end through which a probe can be extended and manipulated by a hand received within the protector. The protector includes laminated layers of aramid fibers together with other tough blast resistant materials such as polycabonate.

16 Claims, 6 Drawing Sheets

HAND PROTECTION SYSTEM

BACKGROUND OF THE INVENTION

1. Field of the Invention

This invention relates to a new or improved hand protection system for use by operatives involved in de-mining operations where they are required to locate, identify and remove anti-personnel mines which may be planted in a ground surface.

2. Description of the Prior Art

Military personnel who are involved in de-mining operations are normally provided with comprehensive protection gear including leggings, abdomen and chest protectors and helmets formed of ballistic blast resistant materials. Such protective clothing is available from a number of sources, and is illustrated in for example U.S. Pat. No. DES 403,487, U.S. Pat. No. DES 397,519, U.S. Pat. No. DES 417,756, U.S. Pat. No. DES 403,487 as well as U.S. Pat. No. 5,966,747, U.S. Pat. No. 5,946,719 and U.S. Pat. No. 5,328,447 all assigned to the assignee of the subject application, and the disclosures of which are incorporated herein by reference.

The equipment described and shown in the above referred to patents provides protection against the effects of exploding anti-personnel mines, but is not inexpensive. On the other hand as a result of various conflicts and insurrections, vast numbers of anti-personnel mines have been planted in many countries, particularly countries of the third world where they provide a continuing menace to the lives and safety of both inhabitants and livestock.

Although International agreements have been signed in recent years by many countries forswearing the use of land mines, this does not resolve the problem posed by the millions of land mines that have been widely deployed in many countries and that remain in place.

In terms of the total damage inflicted, anti-personnel mines pose the most serious problem, both because of their vast numbers, and because of the fact that they are easily triggered by an adult, child or domestic animal, often with devastating consequences resulting in death or maiming or loss of limbs.

Mine clearance or de-mining is a dangerous occupation even when performed by well trained and well equipped operatives. However the danger becomes extreme when the work is carried out by untrained or ill equipped individuals. Nevertheless in many third world countries the imperative of performing mine clearance to regain use of mined land can sometimes override safety concerns, so that de-mining operations will frequently be carried out by operatives who do not have adequate protective gear.

Once the approximate location of an anti-personnel buried in the ground has been identified and marked, it then becomes necessary for an operative to go to the marked location, crouch down, and using careful movements of hands and of probing tools uncover the mine so that it can be identified and either removed or safely exploded. The operations required in this are delicate and it is all too easy for a mine to be inadvertently detonated. In such circumstances, the fingers and hands of the operative doing the work are most likely to suffer damage since they are closest to the detonating mine.

SUMMARY OF THE INVENTION

It is an object of the invention to provide a hand protective system that is designed to provide improved protection to the fingers and hands and preferably also the wrist and lower arms of de-mining personnel without unduly hampering the necessary hand manipulations that are required during de-mining.

The invention accordingly provides a hand protection system for use by an operative in locating and/or identifying anti-personnel mines planted in a ground surface, said system comprising: a hand protecting shield configured to receive a hand of the operative and at least part of the associated wrist and forearm, said shield comprising a stiff reinforced shell formed of multiple overlapped layers of densely woven aramid fibers laminated together with a molded form of stiff polycarbonate material, said shield being elongated and of a lateral peripheral extent sufficient to enclose at least the back and side regions of the hand and wrist of the operative.

The shield must be extremely strong without being unduly heavy, and preferably comprises up to eight overlapped layers of densely woven Kevlar™ (aramid fibers) laminated together on one or both sides of the polycarbonate form.

The shield has a length sufficient to cover the fingers and hand of the operative, and may also include a cuff which extends over the wrist and part of the forearm. The cuff region, being more remote from the probable detonation site, need not be as strong as the hand-covering portion, and may for example omit the stiff polycarbonate form.

The shell preferably has outer and inner layers of waterproof and abrasion resistant material to avoid absorption of liquid, e.g. from sweat, which would add undesired weight. For comfort the inner side of the shield may include a cotton material that contacts the skin of the operatives hand.

In one version the shield is trough-shaped having a transversely arched profile with an open rear end and a front part that is tapered towards a rounded nose, the shield being open on its underside and to the rear but being otherwise unperforated. Preferably there is a transverse handle spanning between the sides of the shield and spaced from the front end such that when the handle is positioned between the thumb and index finger of the operative, the tips of the fingers cannot be extended substantially beyond the rounded front end of the shield. A transverse elasticized band may be positioned in a cuff portion of the shield to maintain it against the back of the hand and wrist of the operative.

In a second version, the shield is cone-shaped tapering to a narrow front end having an aperture through which a rod-like probe can be inserted to extend forwardly for use in probing the ground. The operative grips the probe within the cone and the cone provides protection to the gripping hand. The narrow end of the cone can include a rubber grommet having a hole through it for tightly engaging with the probe. The grommet may be adjustable from a position where it tightly grips the probe to a position where it releases the probe for longitudinal movement or extraction. Preferably there is a cuff that extends rearwardly of the shield to provide protection to the wrist and forearm of the operative, the cuff being of strong protective material, but preferably being flexible. The cuff can be of tubular form, or can be semi-tubular, being open on its upper side.

BRIEF DESCRIPTION OF THE DRAWINGS

The invention will further be described, by way of example only, with reference to the accompanying drawings wherein.

DESCRIPTION OF THE PREFERRED EMBODIMENTS

Figure 1:
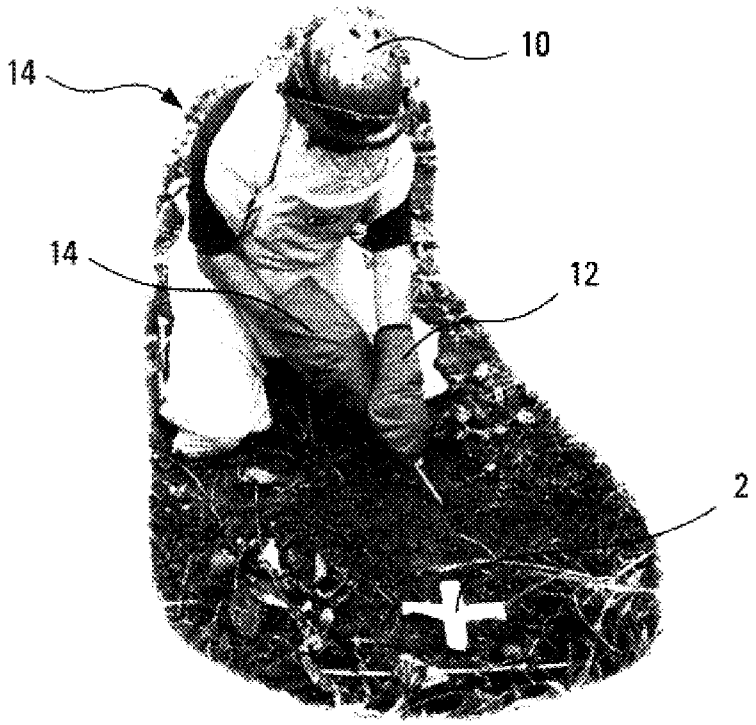
FIG. 1 is a perspective view illustrating the hand protection system of the invention in a preferred embodiment as used by a mine clearance operative.

As shown in FIG. 1, the likely location of a buried mine is marked by a cross 2 on the ground, as a result of a preliminary sweep conducted by a mine detector (not shown). At this stage a mine clearance operative 4 has to investigate the site of the suspected mine and identify and/or uncover it. This is dangerous and delicate work since the operative must crouch down or kneel adjacent the site marked by the cross 2, and gently probe the area with a rod 6 or the like to precisely locate the anti-personnel mine. The operative of course will wear protective clothing, particularly on the front of the legs, groin and chest, and a helmet 10, and these measures provide adequate protection to the associated body parts in the event that an anti-personnel mine is detonated. However of necessity the hands of the operative must be close to the suspected mine location, and accordingly are particularly vulnerable to injury in the event of a mine being inadvertently detonated in the mine clearing operation. It is therefore highly desirable to provide enhanced protection to these vulnerable parts. However on the other hand the protection provided must not unduly hamper the hands of the operative in performing the necessary duties such as manipulating the probe rod 6, and sometimes employing the fingers to clear soil and debris from around the suspected mine.

The hand protection system of the present invention therefore involves two hand protecting shields 12, 14 worn on opposite hands of the operative. As shown in FIG. 1 the shield 12 is worn on the right hand and the shield 14 on the left hand, but depending upon the handedness of the operative, these positions could be reversed.

Figure 3:
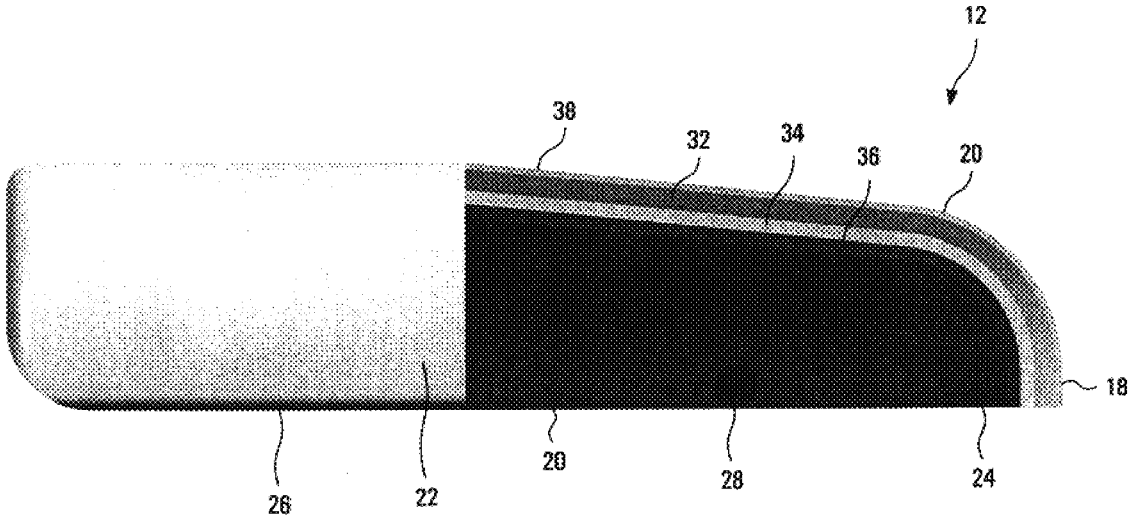
FIG. 3 is a side elevation to an enlarged scale and partly in longitudinal section showing one embodiment of a hand shield as used in the protection system.
Figure 4:
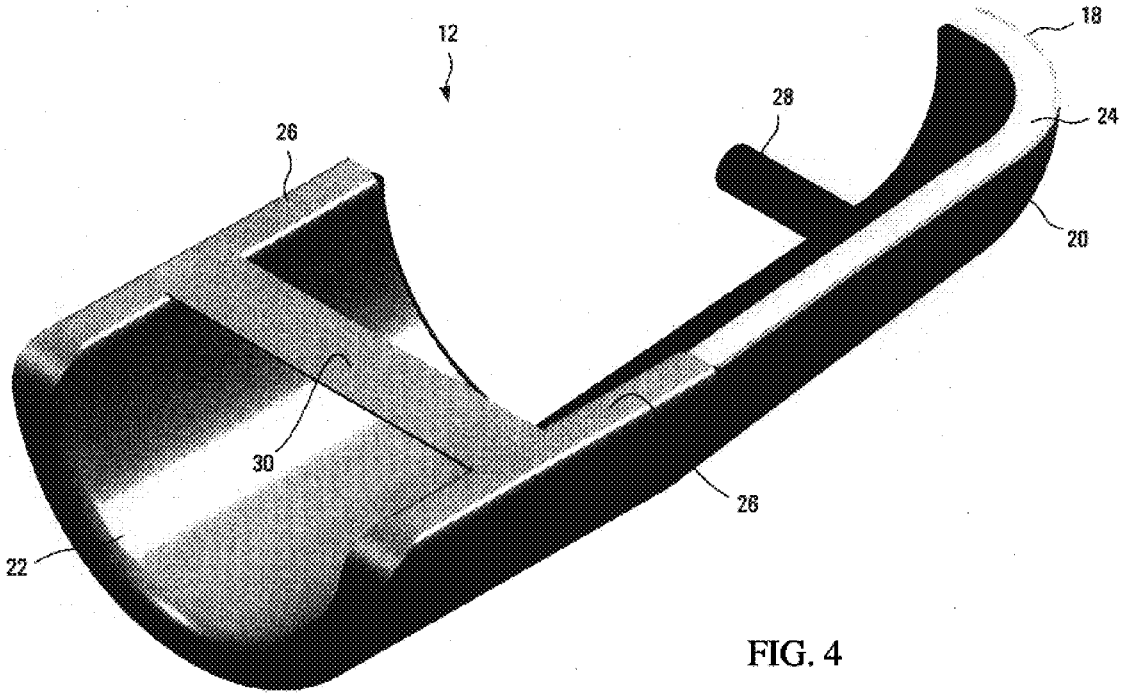
FIG. 4 is a perspective view partially fragmented showing the underside of the shield of FIG. 3.

As better shown in FIGS. 3 and 4, the shield 12 comprises a convex shell which is open at its underside and at its rear end (FIG. 4) and which tapers to a rounded front end 18. The shield has a hand-covering front portion 20 which tapers towards the front end and a rearwardly extending cuff portion which is part-cylindrically curved, the lower edges 24, 26 of the front and rear portions respectively being coplanar. A rod-like handle 28 is mounted at its ends at opposite sides of the front portion 20, and spans between these sides. An elasticized band 30 spans across the lower edges of the cuff portion 22.

The structure of the hand protecting shield 12 is shown in the sectioned portion of FIG. 3 and comprises a molded shell of tough plastic material such as Lexan™ polycarbonate of a thickness of approximately 0.093 inch.

On the inner side of the shell 32 are a series of layers of tightly woven aramid fibers. As shown in FIG. 3 there are eight layers of Kevlar™. The polycarbonate and fabric layers provide the desired level of ballistic protection, this structure being covered on the inside by a cotton layer 36 and on the outside by a layer 38 of rubberized material, or a protective material, such as heavy duty nylon. The cotton layer 36 comes into contact with the skin of the operative and therefore must provide a degree of comfort, but otherwise the structure of the shield is impermeable to moisture. Absorption of moisture by the shield would be undesirable since it would add to its weight. The cuff portion 22 being at the distal end of the shield does not require the same degree of strength and toughness and therefore does not include the polycarbonate shell, but does however include multiple layers (not shown) of woven aramid fibers.

As will be clear from the foregoing description and the accompanying drawings, in use the shield 12 is placed over the back of the hand and is retained in position by the elasticized band 30 against the underside of the wrist or forearm of the operative. The handle 28 is positioned adjacent the open underside of the shield, and is designed to be engaged in the cleft between the thumb and index finger of the operative. When worn as described, the open underside of the shield 12 enables the operative to use his fingers either to help guide the rod 6 as shown in FIG. 1 or to clear debris and soil from around the suspects mine location. The handle 28 is positioned such that when engaged as described above, it prevents extension of the fingers of the operative's hand substantially beyond the front end 18 of the shield, thus limiting the potential injury to the fingers in the event of a mine detonation.

Figure 5:
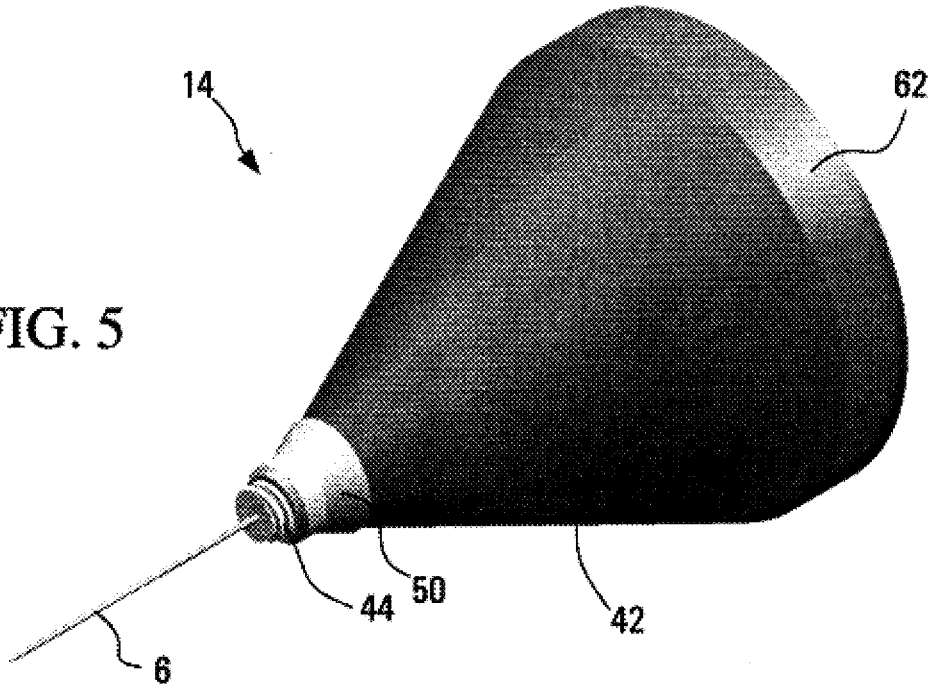
FIG. 5 is a perspective view showing a further embodiment of hand shield of the protection system of the present invention.
Figure 6:
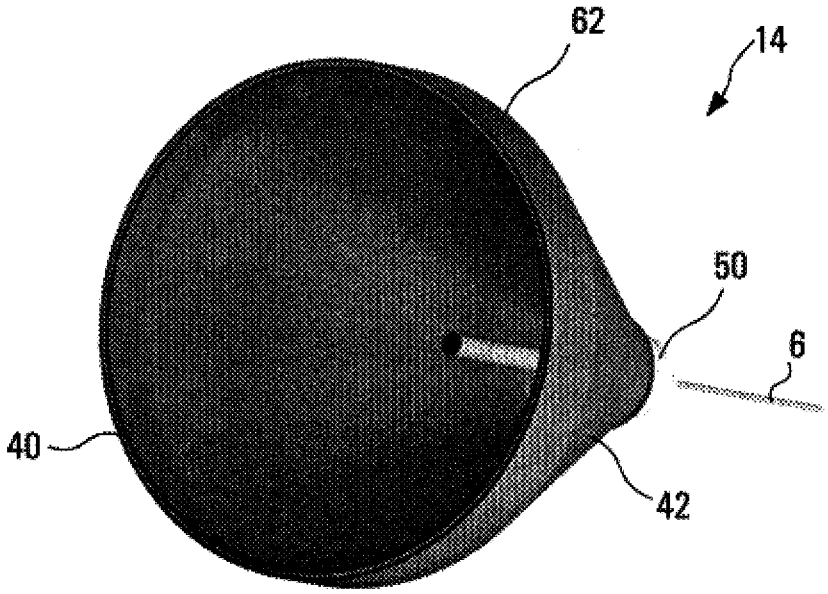
FIG. 6 is a perspective view showing the opposite side of FIG. 5.
Figure 7:
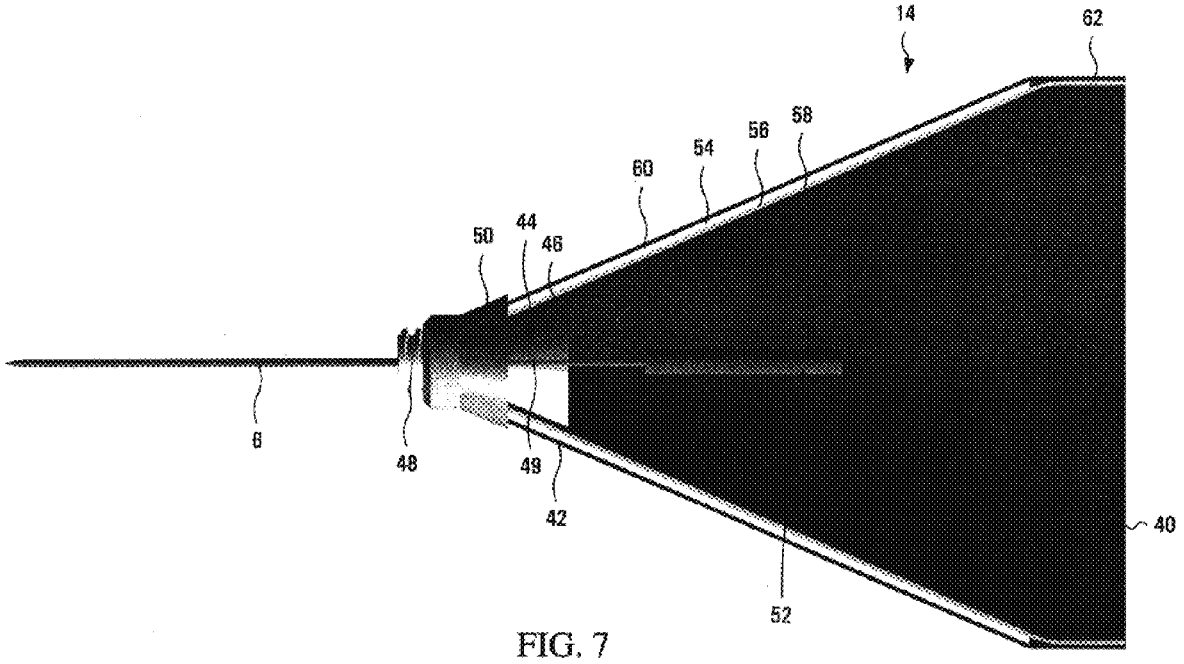
FIG. 7 is a longitudinal sectional view of the embodiment of FIG. 5 drawn to an enlarged scale.

The second hand protecting shield is shown in FIGS. 5, 6 and 7 and comprises a conical structure having an open rear end 42 and tapering to a front end 43. At the front end there is an opening filled by a screwthreaded rubber plug 44 which has a conically shaped rear end 46 that sits against the inner side of the shield, the plug having a forwardly projecting threaded part 48 which is engaged by a threaded plastic cap 50. An axial hole (not shown) extends through the rubber plug 44 providing a passage for a thin metal probe rod 6 which extends forwardly of the shield 14 and which has within the interior of the shield a cylindrical handle 52.

The rear end 46 of the rubber plug is split into wedge-shaped sections by axially extending slits 49 so that when the threaded plastic cap 50 is tightened into engagement with the threaded part 48, the sections of the rear end 56 are cammed through interaction with the tapered inner surface of the shield to press radially into tight engagement with the rod 6 thus gripping it securely in a selected position of adjustment. To remove or to reposition the rod it is merely necessary to slacken off the threaded plastic cap 50 whereupon the pressure on the rod is relieved and it can be moved as desired.

The structure of the conical portion of the shield 14 can be essentially identical to that of the front portion 20 of the shield 12 namely including a conical Lexan™ shell 54 on the inner side of which are up to eight layers of Kevlar™ woven fibers, there being an outer rubber covering layer 60 and an interior cotton layer 58, the structure being altogether impervious to moisture. Beyond the polycarbonate shell 54 there is a rearwardly extending tubular section 62.

Figure 8:
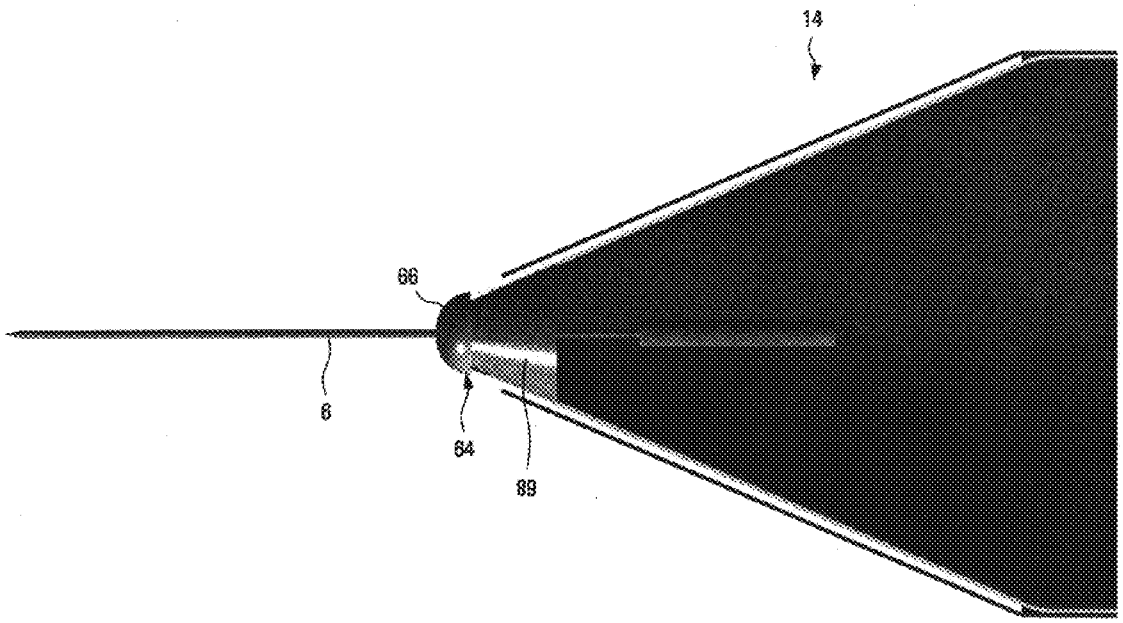
FIG. 8 is a view similar to FIG. 7 showing a modified version.

In the embodiment of FIG. 8 the shield 14 has a simplified arrangement for mounting the rod 6 at its forward end. This arrangement comprises a rubber plug 64 through which the rod 6 extends, the plug having a rounded head 66 outside the shield and a conically tapered body 68 inside the shield.

Figure 2:
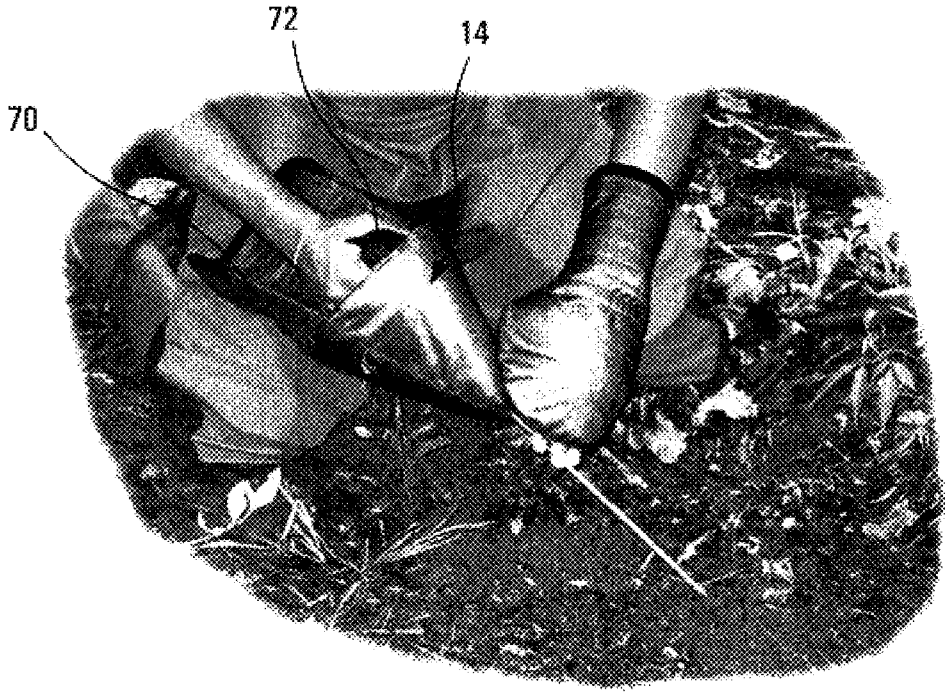
FIG. 2 is a view similar to FIG. 1 showing use of a slightly modified embodiment of the hand protection system.

A further modification of the shield 14 is shown in FIG. 2. Here the shield has an extended semi-tubular cuff 70 which provides a measure of protection to the wrist and forearm of the operative. The rod 6 shown in FIG. 2 is mounted in a pistol grip handle 72 which in some circumstances the operative might find more comfortable to use over extended periods.

Various modifications can be made in the structure as described above. For example the polycarbonate shells can be made in various ways such as thermoform molding or injection molding. A preferred thickness for the polycarbonate shell is about 0.10 inch. Commercially available Lexan™ sheet of a thickness of 0.093 inch has been found suitable. Instead of Lexan™, the polycarbonate sheet could be of Macrolon™ 3103, particularly where the shells are to be formed by injection molding.

The configuration of the shield could be modified to include other materials. For example foam materials such as polyethylene foam (LD45 with a grade of 2.8 pcf) and a thickness of ¼ inch could be interposed between the polycarbonate shell and the Kevlar™ layers.

The rubberized layers could be replaced by heavy duty nylon such as the ballistic nylon sold under the Trade mark CORDURA.

While various presently preferred embodiments and elements of the invention are described in the foregoing and shown in the drawings, it will be appreciated that details of the structures employed can be varied widely without departing from the spirit and scope of the invention as set forth in the appended claims.

What is claimed is:

1. A hand protection system for use by an operative in locating and/or identifying anti-personnel mines planted in a ground surface, said system comprising:

a rigid protecting shield configured to receive a hand of the operative and at least part of the associated wrist and forearm, said shield comprising a stiff reinforced shell formed of multiple overlapped layers of densely woven aramid fibers laminated together with a molded form of stiff polycarbonate material said form of polycarbonate material being positioned outwardly of the aramid layers with respect to the hand to be protected and having a thickness of about 0.1 inch, said shield being elongated and of a lateral peripheral extent sufficient to enclose at least the back and side regions of the hand and wrist of the operative.

2. A system as claimed in claim 1 wherein the shield has outer and inner layers of abrasion resistant material.

3. A system as claimed in claim 2 wherein said abrasion resistant material is a rubberized fabric.

4. A system as claimed in claim 2 wherein said inner layer incorporates a cotton material for contact with the skin of the operative.

5. A system as claimed in claim 1 wherein said shield is trough-shaped having a transversely arched profile and having an open rear end and a front part that is slightly tapered towards a rounded nose, the shield having an open underside and rear end but being otherwise unperforated.

6. A system as claimed in claim 1 wherein the shield has a transverse handle attached thereto just above the open underside thereof and spaced from the front end at a location such as to be received between the thumb and index finger of the hand of the operative in a location such that the operative's fingers cannot be extended substantially beyond the rounded front end of the shield.

7. A system as claimed in claim 6 wherein said shield includes a transverse elasticized band in a cuff portion thereof, said band being positioned to maintain said shield against the back of the hand and wrist of the operative.

8. A system as claimed in claim 1 wherein said form of polycarbonate material is produced by injection molding.

9. A hand protection system for use by an operative in locating and/or identifying anti-personnel mines planted in a ground surface, said system comprising:

a protecting shield configured to receive a hand of the operative and at least part of the associated wrist and forearm, said shield comprising a stiff reinforced shell formed of multiple overlapped layers of densely woven aramid fibers laminated together with a molded form of stiff polycarbonate material, said shield being elongated and of a lateral peripheral extent sufficient to enclose at least the back and side regions of the hand and wrist of the operative, and wherein said shield is cone-shaped, tapering to a narrow front end, said front end including an aperture through which a rod-like probe can be inserted for engagement by the hand of the operator within the shield, the probe extending forwardly of the narrow end of the shield to a tip for probing exploration in the ground surface under control of the hand of the operative.

10. A system as claimed in claim 9 including a grommet at the narrow front end of the shield, said grommet defining an aperture for tightly engaging with the probe.

11. A system as claimed in claim 10 wherein said grommet is adjustable to engage tightly onto the probe or to selectively release the probe for movement therein.

12. A system as claimed in claim 9 wherein a cuff is connected to the large rear end of the shield to extend rearwardly thereof to provide protection to the wrist and forearm of the operative.

13. A system as claimed in claim 12 wherein said cuff is fabricated from strong protective but flexible material.

14. A system as claimed in claim 12 wherein said cuff is of tubular form.

15. A system as claimed in claim 13 wherein said cuff is of approximately semi-tubular form.

16. A system as claimed in claim 9 wherein said form of polycarbonate material is produced by injection molding.

* * * * *